US005697720A

United States Patent [19]

Lhuisset

[11] Patent Number: 5,697,720

[45] Date of Patent: Dec. 16, 1997

[54] DEVICE FOR WIPING LIQUID FROM A BRUSH UPON REMOVAL OF THE BRUSH FROM A LIQUID-FILLED CONTAINER

[75] Inventor: François Lhuisset, Montgeron, France

[73] Assignee: LVMH Recherche, Colombes, France

[21] Appl. No.: 244,733

[22] PCT Filed: Jul. 24, 1992

[86] PCT No.: PCT/FR92/00738

§ 371 Date: Jan. 24, 1994

§ 102(e) Date: Jan. 24, 1994

[87] PCT Pub. No.: WO93/01736

PCT Pub. Date: Feb. 4, 1993

[30] Foreign Application Priority Data

Jul. 25, 1991 [FR] France ..... 91 09452

[51] Int. Cl.[6] ..... A45D 40/00

[52] U.S. Cl. ..... 401/122; 401/129

[58] Field of Search ..... 401/122, 129

[56] References Cited

U.S. PATENT DOCUMENTS

| | | | |
|---|---|---|---|
| 2,703,898 | 3/1955 | Kellett | 401/122 |
| 3,084,374 | 4/1963 | Ziegler | 15/521 |
| 3,372,424 | 3/1968 | Kellett | 401/122 X |
| 3,558,022 | 1/1971 | Zytko | 401/122 X |
| 3,861,810 | 1/1975 | Vasas | 401/122 |
| 3,908,675 | 9/1975 | Spatz et al. | 401/122 X |
| 4,470,425 | 9/1984 | Gueret | 401/122 X |

FOREIGN PATENT DOCUMENTS

| | | | |
|---|---|---|---|
| 8802680 | 4/1988 | WIPO | 401/122 |
| 9101097 | 2/1991 | WIPO . | |

*Primary Examiner*—Steven A. Bratlie
*Attorney, Agent, or Firm*—Steinberg, Raskin & Davidson

[57] ABSTRACT

A device for wiping and/or drying a brush for applying a liquid from a container to a portion of the body, such as mascara for eyelashes, and a container including the same. The device includes a sleeve insertable into the neck of the container and having a first open end, a second end provided with articulated flaps, and a wall between the first and second end and provided with lugs radially deformable towards an axis of the sleeve upon insertion of the sleeve into the neck of the container. The lugs constitute a stop for the flaps during the withdrawal of the brush through these flaps while the flaps are, upon insertion of the brush into the container through the sleeve, freely pivoting to permit this insertion.

20 Claims, 3 Drawing Sheets

DEVICE FOR WIPING LIQUID FROM A BRUSH UPON REMOVAL OF THE BRUSH FROM A LIQUID-FILLED CONTAINER

FIELD OF THE INVENTION

The present invention has essentially as its subject a device for wiping a brush upon its removal from a liquid-filled container.

It is also directed to a container with a brush for mascara for eyelashes including the device.

BACKGROUND OF THE INVENTION

One has already proposed devices for application liquids for eyelashes comprising in a general manner a brush carried by a stopper adapted to obturate a tank which contains the liquid product, such for example as mascara.

These devices generally comprise one or several elements mounted within the neck of the container so as to permit, on one hand, the guiding without scraping of the brush when one inserts it into the container and on the other hand, the wiping or drying of the brush upon extraction of the brush from the container.

However, the means arranged in the neck of the container for providing these two functions where somewhat complicated, thereby increasing the price of the apparatus and they did not always provide a good reliability and satisfactory results.

OBJECTS AND SUMMARY OF THE INVENTION

Therefore the present invention proposes a drying device which is not very expensive to manufacture, with a very simple mechanical design yet providing complete satisfaction from the standpoint of the guiding of the brush upon insertion into the container as well as from the wiping and/or drying of the brush upon extraction from the container.

For that purpose the invention has as its subject a device for the drying of a brush or the like, of the type comprising a sleeve insertable into the neck of a container, characterized in that the sleeve comprises one open end, another end provided with articulated flaps and a wall provided with lugs or the like radially deformable towards the axis of the sleeve at the insertion of the sleeve into the neck of the container, the lugs thus constituting a stop for the flaps upon the withdrawal of the brush through these flaps which at the insertion of the brush are freely pivoting to permit this insertion.

According to another characteristic of this device, the aforesaid flaps comprise notches or the like defining in the position of abutment of the flaps upon the lugs, an opening for the passage and the drying of the brush when one withdraws it through the sleeve. One should further specify here that the aforesaid lugs, which are elastically deformable, comprise a ramp-shaped portion projecting outwards of the sleeve.

According to another characteristic of the invention, this sleeve with the lugs and flaps constitutes one single piece molded from a substantially elastic material such as a thermoplastic elastomer.

According to still another characteristic of the device of this invention the aforesaid lugs are cut out in the wall of the sleeve along a direction substantially parallel to its axis whereas the aforesaid flaps are connected to one end of the sleeve by a thinned portion of material forming a hinge.

According to a preferred embodiment, this device comprises two diametrically opposite lugs the free ends of which form each one an abutment upon which both aforesaid flaps may bear.

According to still another characteristic of this invention, each of the confronting edges of the flaps comprise a notch to define the aforesaid opening, and the flaps are slightly spaced from each other when the sleeve is in the state of rest, i.e. not inserted into the neck of the container.

One should further specify that in the rest condition of the sleeve, the flaps may be slightly bent towards the aforesaid open end of the sleeve. The open end of the sleeve may comprise at least one angular portion projecting towards the outside and adapted to co-operate with the neck of the container.

One therefore understands that the sleeve may quite simply be driven in the manner of a plug into the neck of the container to provide to the latter the functions of guiding and drying of the brush with the best possible reliability.

BRIEF DESCRIPTION OF THE DRAWINGS

Further advantages and characteristics of the invention will appear better in the detailed description which follows and refers to the attached drawings given by way of example only and in which.

DETAILED DESCRIPTION OF THE PREFERRED EMBODIMENTS

Figures 1, 2, 3, 4, 5:
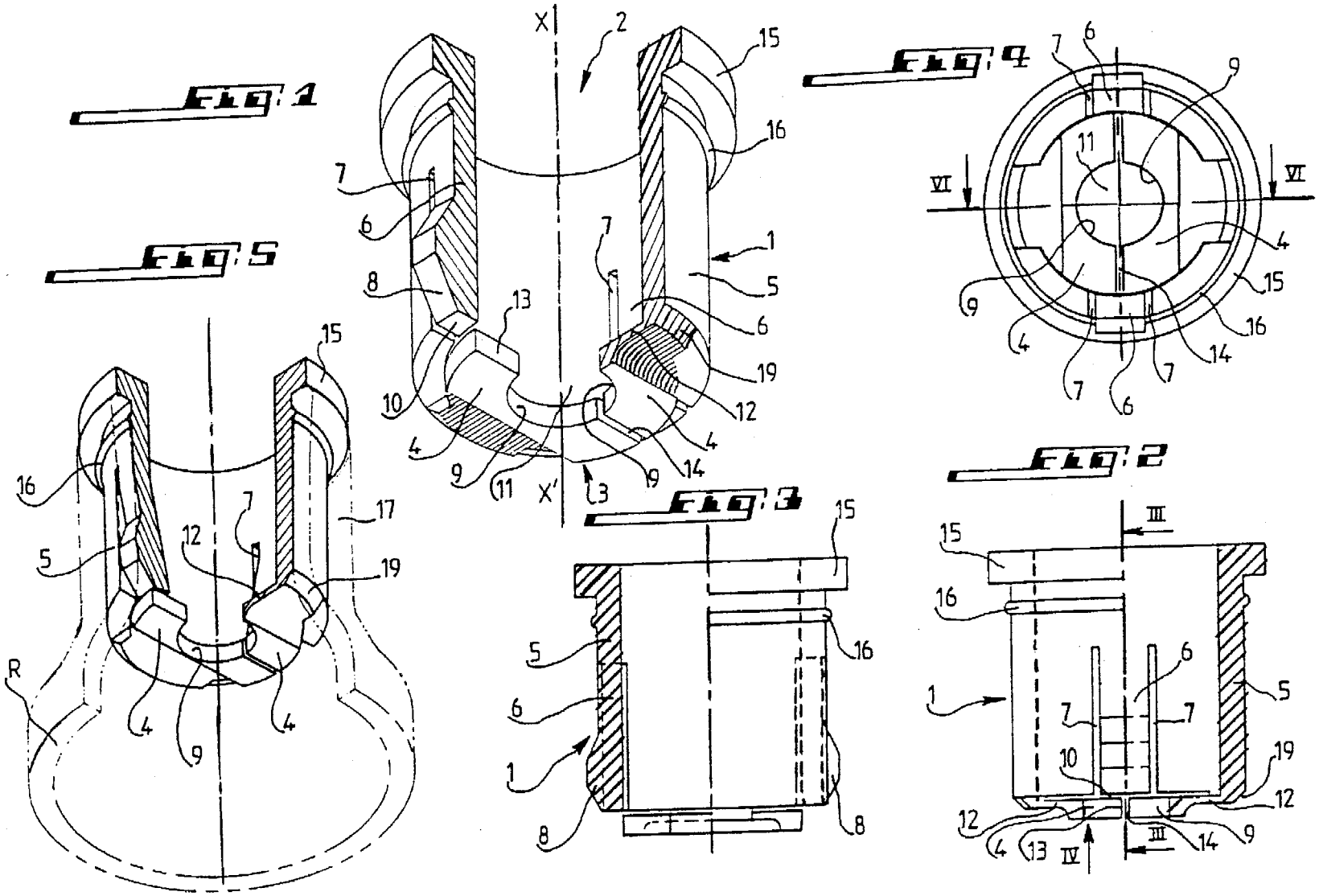
FIG. 1 is a perspective view with parts broken away of a drying device according to this invention.
FIG. 2 is a view in axial section of this device (half-view in axial section, external half-view).
FIG. 3 shows a half-view in section along the line III—III of FIG. 2 and an external half-view.
FIG. 4 is a plan bottom view according to the arrow IV of FIG. 2.
FIG. 5 is a perspective view with parts broken away of the drying device in the position mounted into the neck of a container.

Referring in particular to, FIGS. 1–4, a drying device according to this invention is constituted by a sleeve 1 made from one single piece which may be obtained by the molding of a suitable synthetic material such as for example a thermoplastic elastomer.

The sleeve 1 of substantially cylindrical shape comprises a first open end 2 and a second end 3 which is provided with two flaps or the like 4 articulated onto this end.

In the wall 5 of the sleeve 1 are cut out lugs 6 or more precisely two lugs 6 according to the exemplifying embodiment shown, these lugs extending as shown in the figures along a direction substantially parallel to the axis X–X' of the sleeve 1.

The wall 5 of the sleeve 1 is provided with slots or cuts 7, which slots or cuts define the lugs 6 which are elastically and radially deformable towards the axis X–X' as described below in connection with the operation of the device in accordance with the invention. Each lug 6 comprises a ramp-shaped portion 8 projecting in the normal or rest state of the sleeve 1 outwards of the wall 5 of this sleeve.

Each of the flaps 4 comprises a preferably semi-circular notch or the like 9 so that both notches, when the flaps 4 are coming in abutment onto the free end 10 of both lugs 6, form a passageway or an opening 11 of a substantially circular shape.

Both flaps 4 are articulated onto the end 3 of the sleeve 1 by a thinned portion of material forming a hinge 12 which owing to the material constituting the sleeve 1 will allow the flaps 4 to be constantly urged into the position of abutment against the free ends 10 of the lugs 6.

In this respect, the sleeve 1 could be advantageously made from a thermoplastic elastomer known under the registered trademark "HYTREL" belonging to Du Pont de Nemours, this elastomer being constituted by copolymers blocks of polyterephthalate of butylene and of polyether glycol.

In the free or rest state shown in FIGS. 1–4, the confronting edges 13 of the flaps 4 are slightly spaced from each other as shown at 14.

Figure 6:
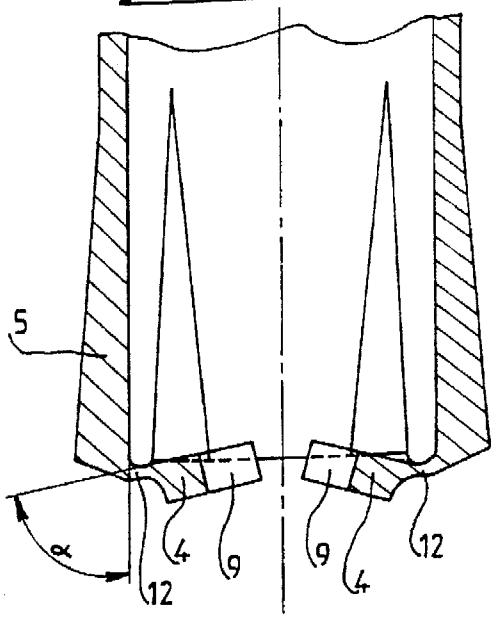
FIG. 6 is a view in section along the line VI—VI of FIG. 4.

As it appears clearly in FIG. 6, the flaps 4 in the rest condition of the sleeve 1 are preferably slightly bent towards the open end 2 of the sleeve 1. Otherwise, the flaps 4 are forming an angle $\alpha$ with the wall 5 of the sleeve 1 which is slightly smaller than 90°. Consequently, there is a prestress of the flaps 4 which exerts itself upwards, this prestress improving in particular after a repeated use of the device, the return of the flaps 4 into abutment onto the lugs 6 and is facilitated by the use of the material mentioned hereabove and constituting the sleeve 1, the hinges 12 and the flaps 4. However such a bending of the flaps 4 is not at all compulsory.

Reverting again to FIGS. 1–4, the open upper portion 2 of the sleeve 1 comprises an annular flange 15 as well as a rib 16 integrally formed by molding or by the material as well as the flange 15 with the cylindrical wall 5 of the sleeve 1.

This flange 15 and this rib 16 permit the retention and the fluid-tightness during the mounting of the sleeve into the neck 17 of a container R as described in detail hereinafter while referring more particularly to FIG. 5 and to FIGS. 7–9.

As shown in FIG. 5, the sleeve 1 is inserted through simple pressure into the neck 17 of the container R, the flange 15 and the rib 16 co-operating with this neck.

During this insertion, the elastically deformable lugs 6 beating with their ramp-shaped portions 8 upon the internal wall of the neck 17 will be bent towards the axis X–X' of the sleeve 1, i.e., inward relative to the wall 5 of the sleeve 1, so that the ends 10 of these lugs will constitute an abutment for the flaps 4 (which are bent towards the open end 2 of the sleeve, the actual degree of bending depending on the length adapted for the lugs 6).

It is to be noted that after insertion of the sleeve 1 into the neck 17, the confronting edges 13 of the flaps 4 will be substantially in contact owing to the slight radial compression towards the axis X–X' of the wall 5 of the sleeve 1.

A brush B with a substantially conical or cylindrical shape and connected to a stem 18 itself rigidly connected to a stopper (not shown) likely to be screwed onto the neck 17 of the container R may then be inserted into the container via the sleeve 1.

Figure 7:
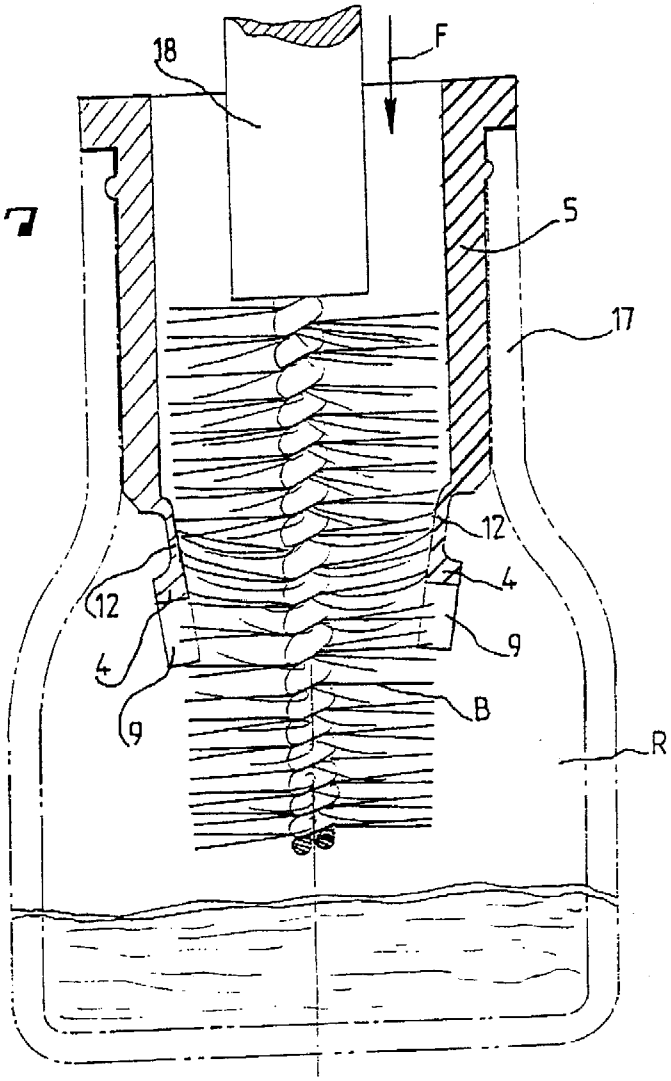
FIG. 7 is a view in axial section showing a brush in the process of insertion through the drying device mounted into the neck of a container.

As shown in FIG. 7, this insertion of the brush B will cause the opening of the flaps 4 which are pivoting about their respective hinges 12 and this under the effect of the force exerted by the thrust of the brush B as physically shown by the arrow F.

Figure 8:
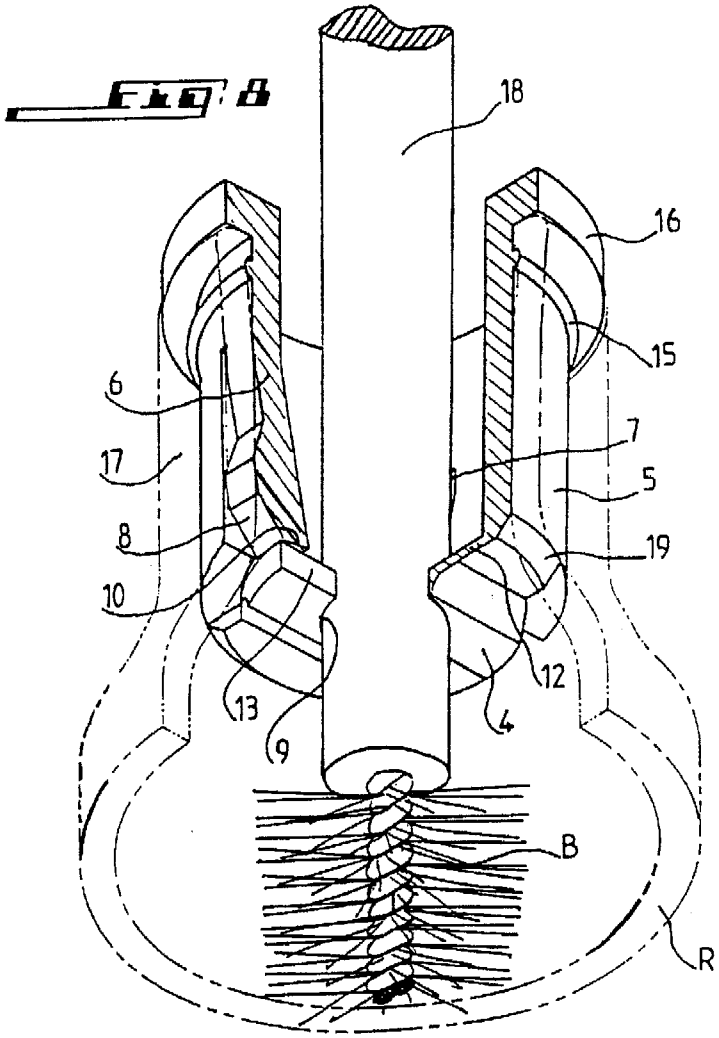
FIG. 8 is a perspective view with parts broken away of the drying device and of the brush in a position fully inserted into the container.

At the end of the insertion of the brush B and as shown in FIG. 8 the flaps 4 will be returned to bear onto the ends 10 of the lugs 6, it being understood that the stem 18 of the brush B will extend through the opening 11 provided by the complementary notches 9 of the flaps 4. The opening 11 has a diameter substantially equal to or even very slightly smaller than that of the stem 18 so that a suitable fluid-tightness will be provided at this level.

For using the apparatus which has just been described, the user will unscrew the stopper (not shown) rigidly connected to the stem 18 and will withdraw the brush B from the container R which may contain any product such as for example, mascara for application to the eyelashes.

Figure 9:
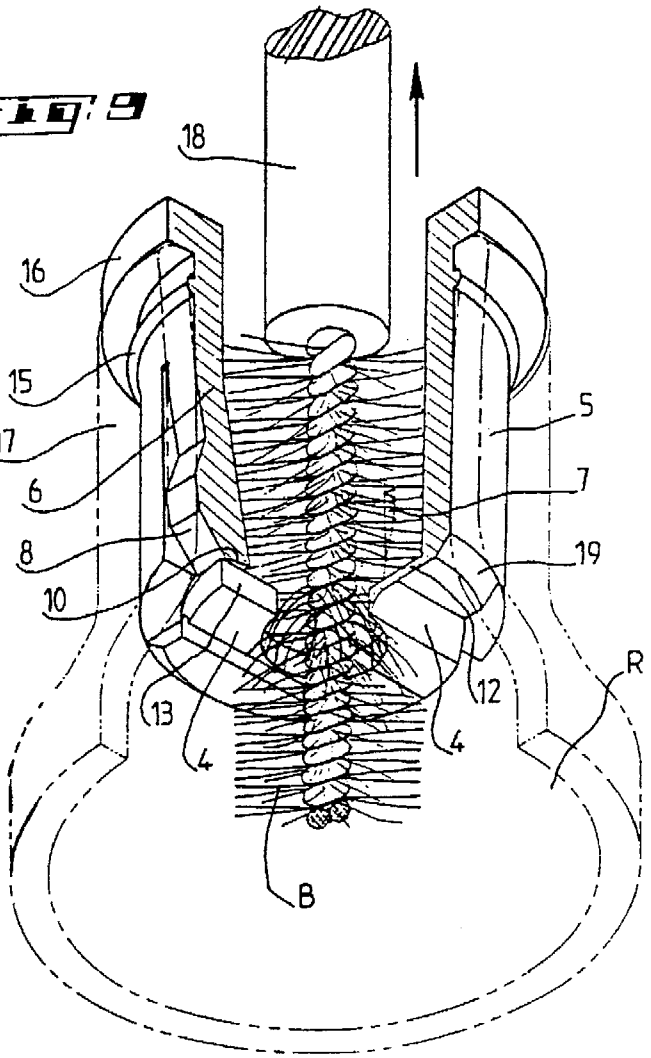
FIG. 9 is a partial perspective view with pans broken away of the brush in the process of withdrawal from the container and which is dried during this withdrawal.

During this withdrawal the flaps 4 will bear upon the ends 10 of the lugs 6 and shown in FIG. 9, the brush B will be dried and/or wiped by the passage through the opening 11 defined by the notches 9 of the flaps 4.

The user will thus have used the brush B impregnated with the desired amount of product, whereafter the brush B could be re-inserted into the container R via the sleeve 1. During the re-insertion of the brush, the flaps practically opposing no resistance, the brush will reach without difficulty and without any deposit of dirt, the inside of the container whereas when it moves out of the container, the flaps beating onto the end of the lugs will oppose a sufficient resistance allowing a suitable drying of the brush.

The invention is of course not at all limited to the embodiment described and illustrated which has been given by way of example only.

Thus the ramp-like portion of the deformable lugs could have any suitable shape and the sleeve 1 could be provided with any additional means ensuring its fluidtightness and facilitating its insertion into the neck of the container as for example a chamfer 19 at the level of its lower end 3. Also the material constituting the sleeve could be any suitable elastic material.

This means that the invention comprises all the technical equivalents of the means described as well as their combinations if the latter are carded out according to its gist.

I claim:

1. Device for wiping liquid from a brush upon removal of the brush through a neck of a liquid-filled container, comprising a substantially cylindrical sleeve insertable into the neck of the container and having a first open end, a second end, and a peripheral wall extending between said first and second ends, articulated flaps arranged at said second end of said sleeve and pivotably connected to said peripheral wall, said flaps being adapted to pivot in a first direction during entry of the brush into the container and in a second direction during withdrawal of the brush from the container, and lugs arranged in said peripheral wall, each of said lugs being formed between a pair of slits in said peripheral wall extending in a direction substantially parallel to a central axis of said sleeve, said lugs being adapted to be radially deformable toward the central axis of said sleeve upon insertion of said sleeve into the neck of the container such that pivoting of said flaps in the second direction during withdrawal of the brush from the container is prevented when said flaps abut against said lugs whereby said flaps thus engage the brush and cause the wiping of liquid from the brush.

2. The device of claim 1, wherein said flaps comprise notches defining an opening for entry and withdrawal of the brush.

3. The device of claim 2, wherein each of said flaps includes a confronting edge, said confronting edges defining said notches and being spaced from each other.

4. The device of claim 1, wherein said lugs comprise a ramp-shaped portion projecting outward from said peripheral wall of said sleeve and are radially deformable relative to said peripheral wall.

5. The device of claim 1, wherein said sleeve with said lugs and said flaps constitutes one single piece molded from a substantially elastic material.

6. The device of claim 1, wherein said sleeve with said lugs and said flaps constitutes one single piece molded from a thermoplastic elastomer.

7. The device of claim 1, further comprising a hinge for pivotably connecting each of said flaps to said peripheral wall.

8. The device of claim 1, wherein said lugs consists of first and second lugs arranged diametrically opposite one another, each of said lugs having a first end integrally connected to said peripheral wall and a second free end, said free end of each of said lugs constituting a stop onto which a respective one of said flaps abuts during withdrawal of the brush from the container.

9. The device of claim 1, wherein said flaps are bent toward when said sleeve of said sleeve when said sleeve is in a state of rest not inserted into the neck of the container.

10. The device of claim 1, wherein said sleeve includes at least one outwardly projecting annular portion arranged at said first end of said sleeve and adapted to co-operate with the neck of the container to retain said sleeve in connection with the neck of the container.

11. Container for storing and dispensing a liquid, comprising peripheral walls defining a compartment receivable of the liquid, one of said wails defining an elongate neck having an opening at an end thereof, a substantially cylindrical sleeve arranged in said neck and having a first open end adjacent said opening of said neck, a second end arranged within said neck, and a peripheral wail extending between said first and second ends, retaining means for retaining said sleeve in said neck, a brush for carrying and applying the liquid, said brush being insertable in a first direction through said sleeve into said compartment to receive the liquid and removable in a second direction through sleeve from said compartment having the liquid thereon, articulated flaps arranged at said second end of said sleeve and pivotably connected to said peripheral wall, said flaps being pivotable in a first direction during insertion of said brush into the compartment and in a second direction during removal of said brush from the compartment, and lugs arranged in said peripheral wail, each of said lugs being formed between a pair of slits in said peripheral wail extending in a direction substantially parallel to a central axis of said sleeve, said lugs being radially deformed toward the central axis of said sleeve such that pivoting of said flaps in the second direction during removal of said brush from the compartment is prevented when said flaps abut against said lugs whereby said flaps engage said brush and cause the wiping of the liquid from said brush.

12. The container of claim 11, wherein said flaps comprise notches defining an opening for entry and removal of said brush.

13. The container of claim 12, wherein each of said flaps includes a confronting edge, said confronting edges defining said notches and being spaced from each other.

14. The container of claim 11, wherein said lugs comprise a ramp-shaped portion projecting outward from said peripheral wall of said sleeve and are radially deformed relative to said peripheral wall.

15. The container of claim 11, wherein said sleeve with said lugs and said flaps constitutes one single piece molded from a substantially elastic material.

16. The container of claim 11, wherein said sleeve with said lugs and said flaps constitutes one single piece molded from a thermoplastic elastomer.

17. The container of claim 11, further comprising a hinge for pivotably connecting each of said flaps to said peripheral wall.

18. The container of claim 11, wherein said lug consists of first and second lugs arranged diametrically opposite one another, each of said lugs having a first end integrally connected to said peripheral wall and a second flee end, said flee end of each of said lugs constituting a stop onto which a respective one of said flaps abuts during removal of said brush from the compartment.

19. The container of claim 1, wherein said flaps are bent toward said first end of said sleeve when said sleeve is in a state of rest not inserted into the neck of the container.

20. The container of claim 11, wherein said retaining means comprise at least one outwardly projecting annular portion of said sleeve adapted to co-operate with said neck.

* * * * *